US006185744B1

(12) United States Patent
Poholski

(10) Patent No.: US 6,185,744 B1
(45) Date of Patent: Feb. 13, 2001

(54) THERMAL VEST

(76) Inventor: Mike Poholski, 7267 Bethel Rd., #27, Goodlettsville, TN (US) 37072

( * ) Notice: Under 35 U.S.C. 154(b), the term of this patent shall be extended for 0 days.

(21) Appl. No.: 09/013,641

(22) Filed: Jan. 26, 1998

(51) Int. Cl.[7] ..... A41D 1/04
(52) U.S. Cl. ..... 2/102; 2/94; 607/108
(58) Field of Search ..... 2/102, 94, 458, 2/69, 81, 95, 97, 108; 607/108, 112, 114; 62/259.3

(56) References Cited

U.S. PATENT DOCUMENTS

| | | | | |
|---|---|---|---|---|
| 1,623,993 | * | 4/1927 | Anderson | 2/102 |
| 4,033,354 | * | 7/1977 | De Rosa | 607/108 |
| 4,061,897 | * | 12/1977 | Thykeson | 607/108 |
| 4,344,620 | | 8/1982 | Debski . | |
| 4,601,067 | | 7/1986 | Buonassissi . | |
| 4,706,672 | * | 11/1987 | Jones | 607/108 |
| 4,856,294 | | 8/1989 | Scaringe et al. . | |
| 5,005,374 | | 4/1991 | Spitler . | |
| 5,031,244 | | 7/1991 | Inagaki . | |
| 5,038,779 | * | 8/1991 | Barry et al. | 2/102 |
| 5,072,455 | * | 12/1991 | St. Ours | 2/102 |
| 5,134,725 | | 8/1992 | Yeshurun et al. . | |
| 5,146,625 | | 9/1992 | Steele et al. . | |
| 5,302,806 | | 4/1994 | Simmons et al. . | |
| 5,305,471 | * | 4/1994 | Steele et al. | 2/94 |
| 5,415,222 | * | 5/1995 | Colvin et al. | 2/102 |
| 5,484,448 | | 1/1996 | Steele et al. . | |
| 5,524,293 | * | 6/1996 | Kung | 2/94 |
| 5,605,144 | | 2/1997 | Simmons et al. . | |
| 5,606,746 | * | 3/1997 | Shelton et al. | 2/102 |
| 5,692,238 | * | 12/1997 | Watson, Jr. | 2/102 |

* cited by examiner

*Primary Examiner*—Amy Vanatta

(57) ABSTRACT

A personal thermal garment has a shell and a thermal insert that overlay and cover a substantial portion of the back and the chest of a user. The shell has inner and outer layers that are interconnected to define a chamber between the layers, the chamber extending substantially throughout the shell and overlaying a substantial portion of the back and chest of the user. An access opening to access the chamber is provided in the shell. The thermal insert can be preheated to warm the user or can be precooled to cool the user. The thermal insert substantially conforms to the chamber and has a body portion with two leg portions that extend in the same general direction from the body portion. The insert body substantially overlays and covers the back of the user, with one of the two legs extending over one of the user's shoulders, and the other of the two legs extending over the other shoulder. The access opening is sized to have a length that is about the same as a width of the thermal insert, to easily and conveniently insert and remove the thermal insert into and from the chamber. The thermal insert may have two congruent layers and multiple compartments defined between the two layers, with one of the compartments being sealed and containing a thermal storage medium. Alternatively, the insert may be constructed in one, integral piece.

17 Claims, 4 Drawing Sheets

THERMAL VEST

CROSS-REFERENCES TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The invention relates to thermal garments. More particularly, the invention relates to active thermal control garments, rather than passive garments that only provide insulation to contain the body heat of the user or to block ambient heat.

In many settings of daily life, in both work and recreational settings, a person will be subjected to excessive heat or cold. Exposure to heat and cold is common for those who work outside, and for some indoor, industrial environments. It is well-known to use insulating clothing to minimize body heat loss in a cold environment and to block high ambient temperature. It is also known to use an active, auxiliary heat source, such as an electric resistance heat insert for gloves and boots, for example.

There are also known some high technology environment suits that provide cooling as well as heating. Such garments are, however, often found in the context of a total environment suit that includes a separate thermal unit that is connected by hoses, or the like, with a thermal barrier and insulated thermal control garment. While this may be appropriate in space exploration or in some specialized terrestrial context, there remain a great number of situations in which a worker or sportsman is subjected to excessive heat or cold, in which the known high technology approach is simply impractical, and in which the know insulating approaches are inadequate.

Consider, for example, the great many settings in which construction workers labor in sweltering summer heat or in numbing winter cold. Active control of one's body temperature under these circumstances will minimize risks of hypothermia and hyperthermia, and will also enhance efficiency and effectiveness in performing the task at hand.

Thus, one will readily appreciate the desirability of a self contained, versatile thermal garment that a worker, or sportsman, may use to help keep warm or cool.

BRIEF SUMMARY OF THE INVENTION

A personal thermal garment according to the invention has a shell that is worn by the user, and that overlays and covers a substantial portion of the back and the chest of the user. The shell has inner and outer layers that are interconnected and define a chamber between the layers. The chamber extends substantially throughout the shell. Thus, the chamber also overlays a substantial portion of the back and chest of the user. An access opening is provided in the shell to access the chamber. And, a thermal insert that can be preheated to warm the user or can be precooled to cool the user is easily and conveniently inserted into and removed from the chamber, through the access opening. The thermal insert substantially conforms to the chamber and has a body portion with two leg portions that extend in the same general direction from the body portion. The access opening is sized to have a length that is about the same as a width of the thermal insert. In one aspect of the invention, the insert body substantially overlays and covers the back of the user, with one of the two legs extending over one of the user's shoulders from the insert body, and with the other of the two legs extending over the other shoulder of the user.

In another aspect of the invention, the insert body may generally be a right quadrilateral portion that wraps around and substantially overlays and covers the user between the shoulders and hips. One of the two legs extends toward one of the user's shoulders, while the other of the two legs extends toward the other shoulder. The insert body may also have first and second opposing ends with the first leg being located near the first end, and the second leg being located near the second end. The insert may further have a third leg that extends over the user's upper back, toward the neck, from the body, and between the first and second ends.

The thermal insert may have two congruent layers and multiple compartments defined between the two layers. At least one of the multiple compartments is sealed closed and contains a thermal storage medium. Alternatively, the insert may be constructed in one, integral piece.

These and other features, objects, and benefits of the invention will be recognized by one having ordinary skill in the art and by those who practice the invention, from the specification, the claims, and the drawing figures.

DETAILED DESCRIPTION OF THE INVENTION

Figure 1:
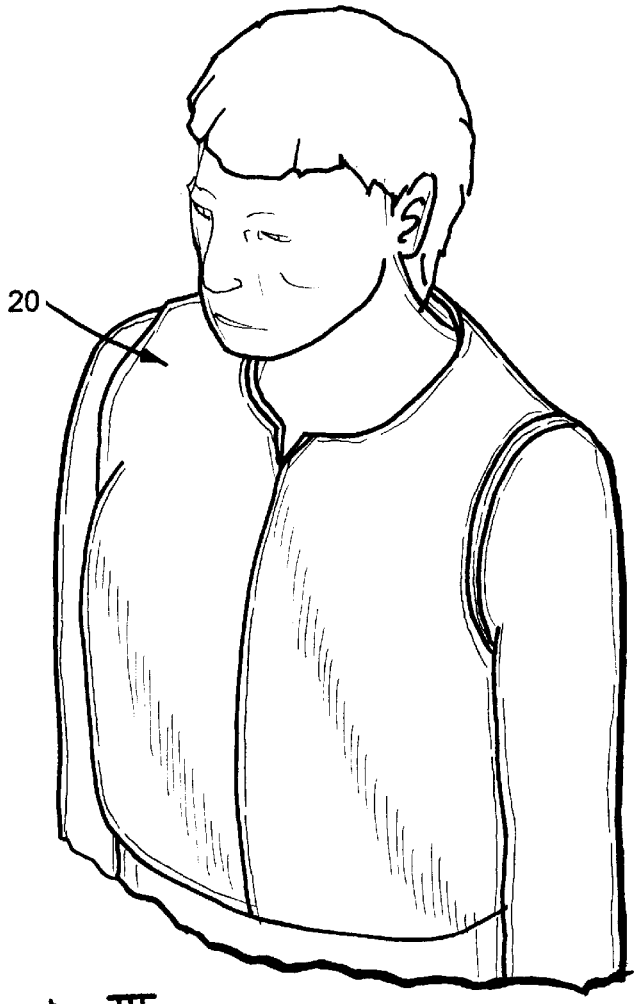
FIG. 1 is a front perspective view of a thermal garment according to the invention as worn by a user.
Figure 2:
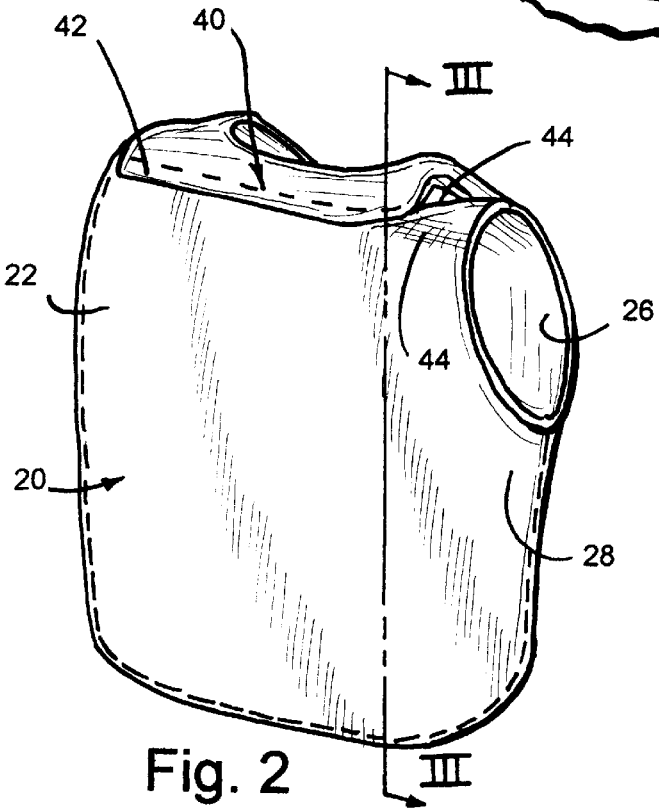
FIG. 2 is a back perspective view thereof, showing an access opening for the thermal insert.
Figure 3:
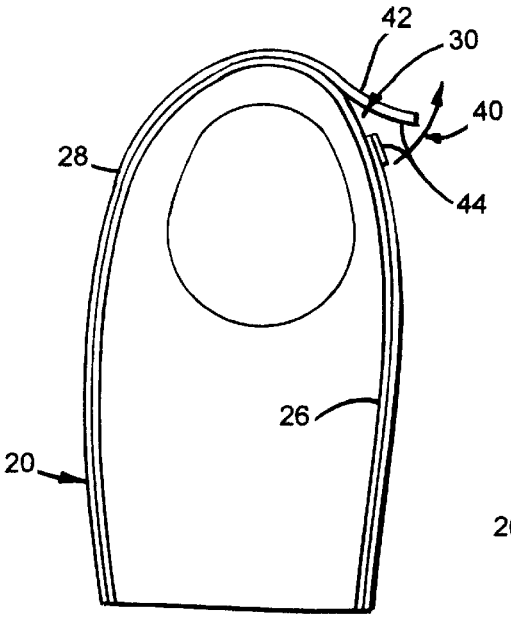
FIG. 3 is a cross-sectional view along section line III—III of FIG. 2.
Figure 4:
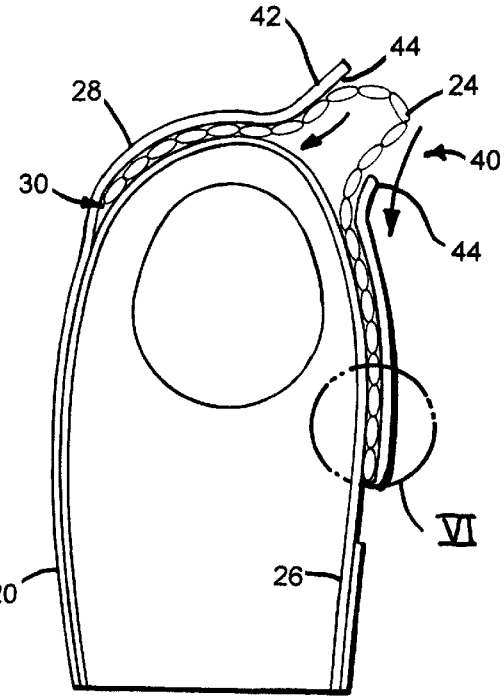
FIG. 4 is the view of FIG. 3, showing the thermal insert in a partially inserted/removed position.
Figure 5:
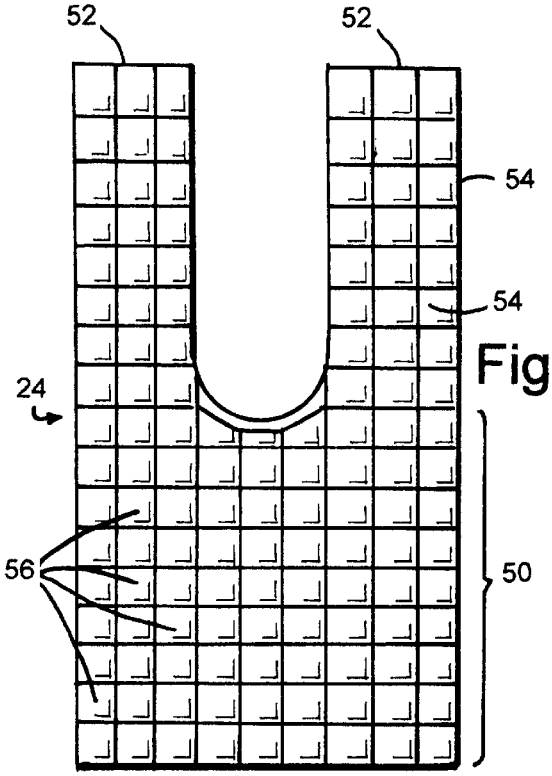
FIG. 5 is a plan view of the thermal insert.
Figure 6:
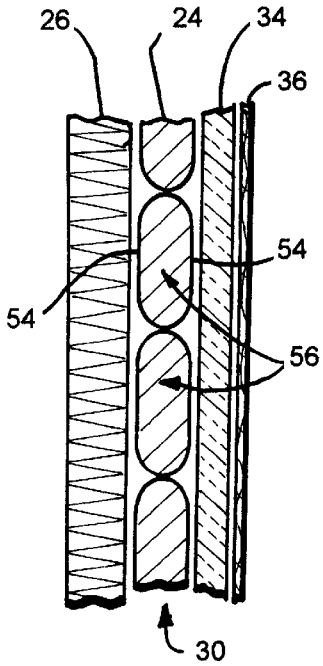
FIG. 6 is an enlarged view of the detail IV of FIG. 4.

A first embodiment of a thermal garment according to the invention is generally shown in the drawing FIGS. 1–6, and is indicated by the reference number 20. The garment 20 comprises two major parts, namely, a shell 22 and a thermal insert 24.

The shell 22 is worn by a user and overlays and covers a substantial portion of the back and the chest of the user. The shell 22 has inner and outer layers 26 and 28, respectively, that are interconnected to define a chamber 30 between the layers. The chamber 30 extends generally throughout the shell 22 and, thus, also overlays and covers a substantial portion of the back and the chest of the user. The inner and outer layers 26 and 28, respectively, may be constructed of any suitable material, including, and not limited to natural fiber fabrics, synthetic fiber fabrics, blended fiber fabrics, and membrane materials, for example, as will be understood by one having ordinary skill in the art.

Most preferably, the inner layer 26 will have an open mesh fiber construction, which may be a high pile, crush resistant cloth that is pliable to conform to the body of the user, and is porous, with good air transfer qualities, to serve as a heat control baffle, for example. The inner layer 26 may also be an open mesh of firm or stiff fibers that are interwoven to define a porous spacer that is also pliable to conform to the body of the user, and is interposed between the user and the thermal insert, for example. In any embodiment, the inner layer 26 preferably modulates or diffuses heat transfer between the user and the thermal insert 24 to distribute the heat transfer in a generally uniform or homogenous thermal flow.

The outer layer 28 will preferably block heat transfer between the thermal insert 24 and the user's environment to define a micro environment within the thermal garment 20, with the thermal insert acting as a heat sink to absorb heat from or radiate heat to the user. Thus, the outer layer 28 may preferably provide thermal insulation and wind blocking qualities. The thermal insulation quality may be provided by a layer of insulating material 34, such as Thinsulate brand insulation or other suitable, garment quality insulation, as one having ordinary skill in the art will understand. The wind blocking property may be provided by any tightly woven fabric 36 or a micro fiber fabric, which are currently popular in the clothing industry, for example. Thus the outer layer 28 may actually be a multiple layer component of the shell 22. The outer layer 28 may alternatively be a single layer of a material that satisfactorily provides the preselected design criteria of a particular configuration of a thermal garment according to the invention.

While the thermal garment 20 is specifically shown in a vest configuration, a thermal garment according to the invention may also be made in any desirable cut or fashion, including a jacket or a coat, for example. In whatever configuration the thermal garment 20 is constructed, it will include an access opening 40 with a length that extends fully across the breadth of the user to provide convenient access to the chamber 30 between the inner and outer layers 26 and 28, respectively, for unrestricted insertion and removal of the thermal insert 24. The access opening 40 is conveniently provided with a full breadth flap 42 across the shoulders of the thermal garment 20. A hook and loop fastener 44 is preferably used to hold the access opening 40 in a closed position and maximize the thermal barrier effectiveness of the outer layer 28. Although, one who practices the invention may choose to use alternative fasteners, as are known in the garment industry.

The thermal insert 24 substantially conforms to the chamber 30 and has a body portion 50 with two leg portions 52 that extend in the same general direction from the body portion. The body portion 50 has a width that is about the same as the length of the access opening 40 to facilitate quick and convenient insertion and removal of the thermal insert 24 into and from the chamber 30 in the shell. The body portion 50 is positioned in the chamber 30 to substantially overlay and cover the back of the user, while one of the two legs 52 extends into the chamber, over one of the user's shoulders, and the other of the two legs 52 extends into the chamber over the other shoulder of the user.

The thermal insert 24 may also have various constructions, including, two congruent layers 54 of material, that are aligned with one another and attached to one another along their perimeter and selectively within the perimeter to define a quilted member with an array of individual compartments 56 defined between the two layers. The array of compartments may be defined in a checker board pattern as is specifically shown in the drawing figures, or may be defined in a box quilting pattern as is understood by one having ordinary skill in the art. Each of the individual compartments 56 is filled with a thermal material during assembly of the thermal insert 24. The choice of how the compartments 56 are defined may be affected by the selection of thermal material.

In one embodiment of the thermal insert 24, the two layers 54 may be any conventional durable and pliable fabric material and the thermal material may be ceramic beads, for example. In a second, alternative embodiment of the thermal insert 24, the two layers 54 maybe a water tight material and the thermal material may be a "freezable" or heatable liquid or jell, for example. Of course, the thermal insert will most preferably remain pliable even after freezing, as will be understood by one having ordinary skill in the art. Also, the two layers 54 may be attached to one another with any suitable method, according to the material selected, including sewing, gluing, or welding, for example, as will be understood by one having ordinary skill in the art.

In use, the thermal garment 28 may be worn by the user to warm or cool the user and to generally insulate the user from his environment. The garment 20 will commonly be prepared for wearing by preheating the thermal insert 24 in an oven or the like or precooling the thermal insert in a refrigerator or freezer or the like. Alternatively, the insert 24 may simply be stored at room temperature for use in a moderate environment, to provide a heat sink. With the thermal insert 24 previously prepared by heating or cooling and the like, the insert is inserted into the chamber 30 of the garment 20 through the access opening 48. So assembled, the garment 20 is worn by a user and the thermal insert 24 generally surrounds the torso of the user, to provide a heating or cooling thermal source. With the thermal insert spaced from the user by the thermal baffle of the inner layer 26, heat flow between the user and the insert 24 is moderated to minimize hot and cold spots.

Figure 7:
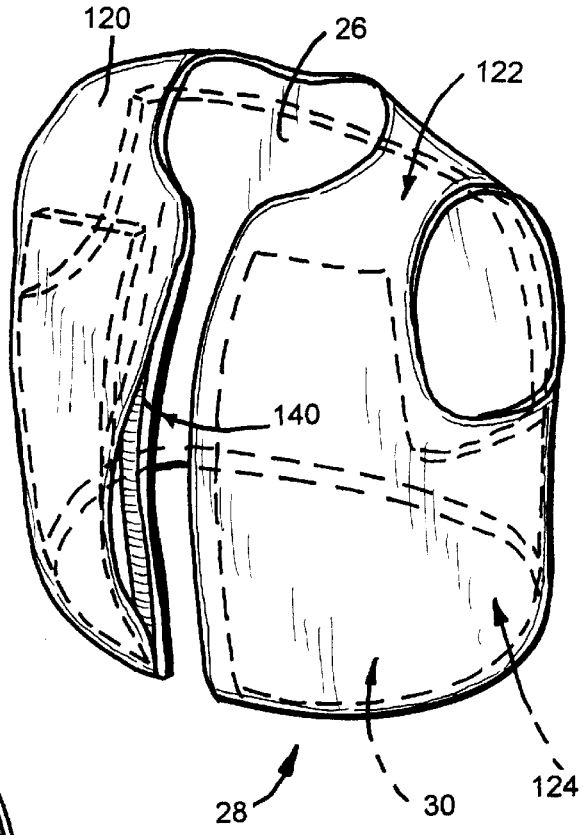
FIG. 7 is a front perspective view of a first alternative embodiment of a thermal garment according to invention.
Figure 8:
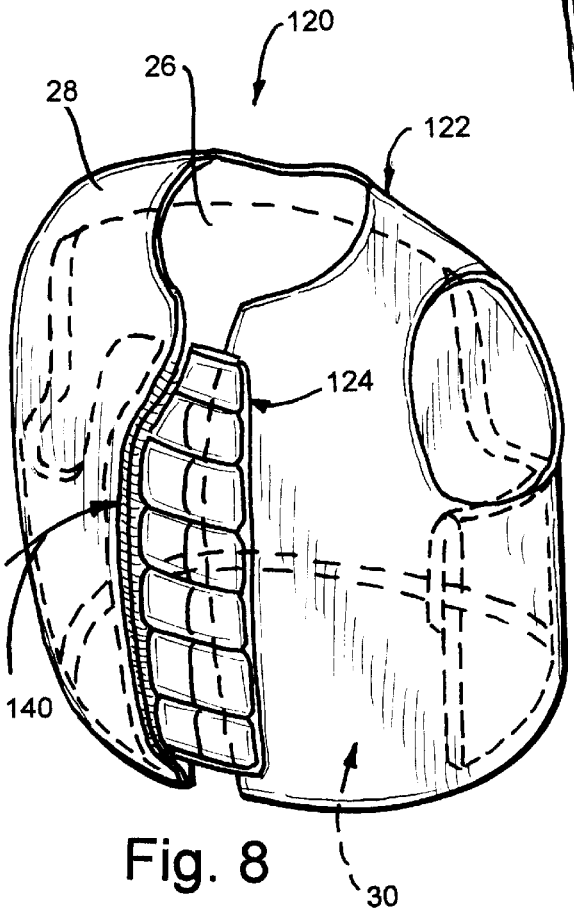
FIG. 8 is the view of FIG. 7, showing the thermal insert in a partially inserted/removed position.
Figure 9:
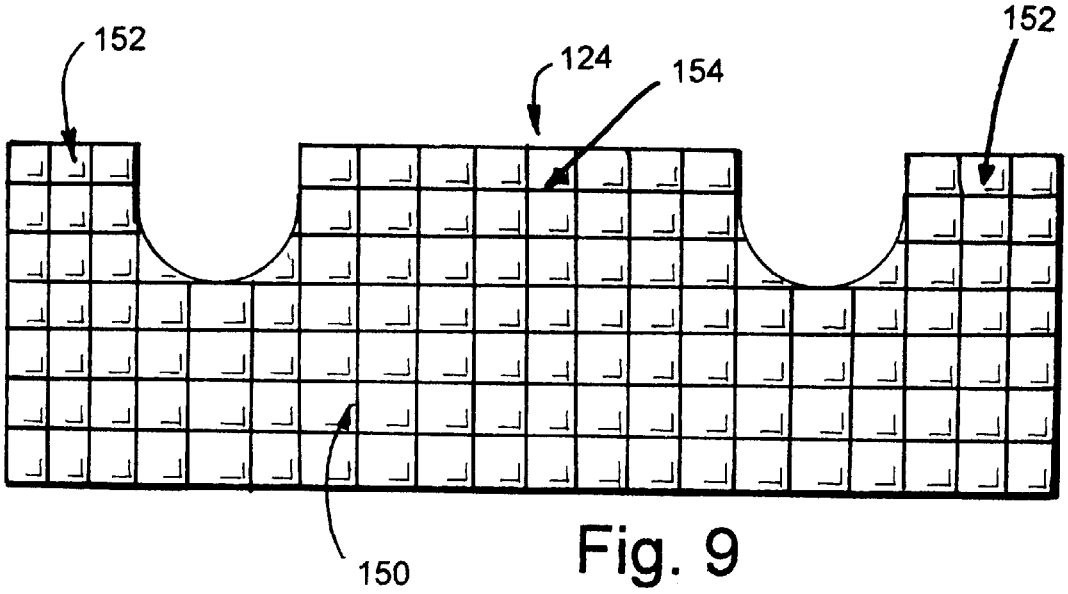
FIG. 9 is an elevational view of the thermal insert for the first alternative embodiment.

A first alternative embodiment 120 of a thermal garment according to the invention is a generally shown in the drawing FIGS. 7–9. The garment 120 also comprises two major parts, namely a shell 122 and a thermal insert 124, each substantially as discussed above in greater detail regarding the garment 20, shell 22 and thermal insert 24. The garment 120 differs from the garment 20, discussed above, in the configuration of the thermal insert 124 and the access opening 140. Because of the substantial similarities between the garments 20 and 120, common reference numbers will be used for common elements, and only the differences will be discussed.

In the thermal garment 120, the access opening 140 is positioned adjacent the front placket of the garment and incorporated into the perimeter seam between the inner and outer layers 26 and 28, respectively, of the shell. The access opening 140 may be closed with a hook and loop fastener, a zipper, or an alternative fastener, as is known in the garment industry. With the access opening 140 located along the front placket 160 of the garment 120, the thermal insert 124 is fed through the access opening and into the chamber 30 to wrap around the user.

Depending upon the specific requirements of the user, the thermal insert 124 may have alternative configurations. In a first configuration, the thermal insert 124 has a quadrilateral body portion 150 with two opposing ends, and two legs 152 that extend in the same general direction from the body portion (FIG. 9). One of the two legs 152 is located at one of the two opposing ends, and the other of the two legs 152 is located at the other of the two opposing ends of the body portion 150. A third leg 154 is generally centered between the first two legs 152, and extends from the body portion 150 in the same general direction as the two legs 152. While the two legs 152 extend over the chest, from the body portion 150 toward the neck or shoulders, of the user, the third leg extends up the back of the user toward the neck or shoulders of the user, when worn.

In a second configuration (not shown), the thermal insert has a generally quadrilateral body portion without any legs. This is substantially only the body portion 150 of the insert 124. In this configuration, the thermal insert is useful to thermally protect the vulnerable lower thoracic area of the user. Further, the second configuration of the thermal insert may be used in combination with the first configuration 122 for extreme conditions to further protect the vulnerable lower thoracic area.

Figure 10:
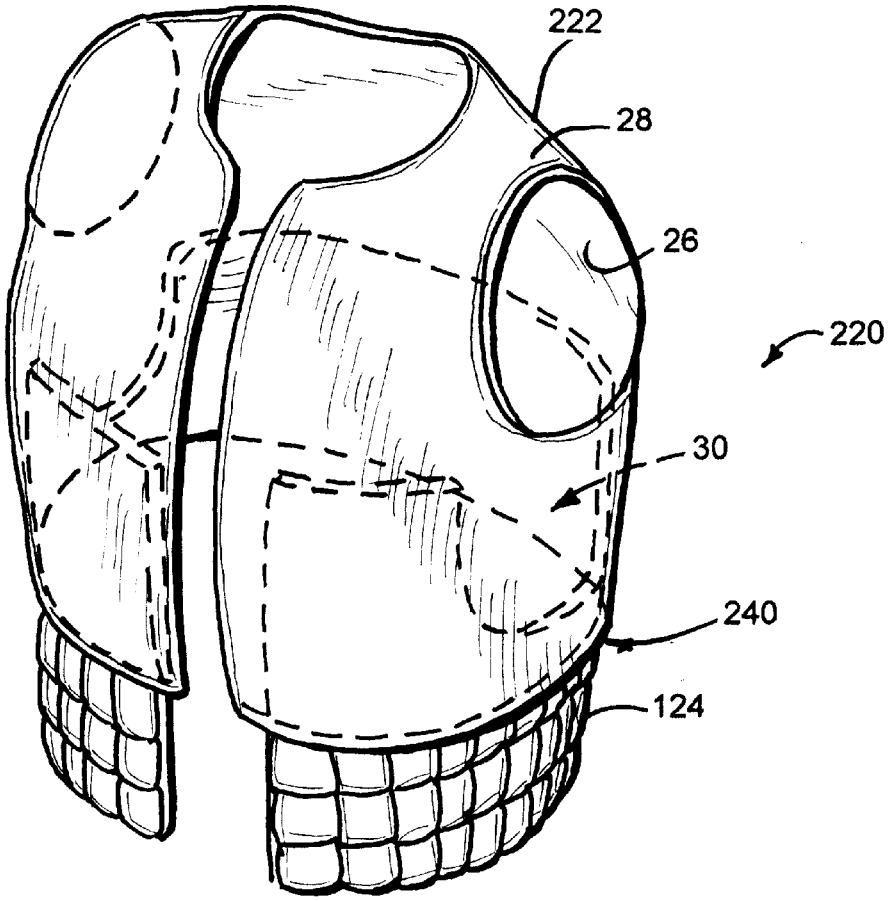
FIG. 10 is a front perspective view of a second alternative embodiment of a thermal garment according to the invention.

A second alternative embodiment 220 of a thermal garment according to the invention is a generally shown in the drawing FIG. 10. The garment 220 also comprises two major parts, namely a shell 222 and the thermal insert 124, again each substantially as discussed above in greater detail regarding the garments 20 and 120, shell 22 and thermal insert 124. The garment 220 differs from the garment 120, discussed above, in the configuration of the access opening 240. Again, because of the substantial similarities among the various embodiments of the garments 20, 120, and 220, common reference numbers will be used for common elements, and only the differences will be discussed.

In the thermal garment 220, the access opening 240 is positioned at the bottom hem of the garment and incorporated into the bottom hem seam, between the inner and outer layers 26 and 28, respectively, of the shell. The access opening 240 may be closed with a hook and loop fastener, a zipper, or an alternative fastener, as is known in the garment industry. With the access opening 240 located along the bottom hem of the garment 220, the thermal insert 124 is fed upward through the access opening and into the chamber 30.

It will be understood by one having ordinary skill in the art and by others, that various modifications and improvements may be made without departing from the spirit of the disclosed concept. Various relational terms, including left, right, front, back, top, and bottom, for example, are used in the claims only to convey relative positioning of various elements of the claimed invention. The scope of protection afforded is to be determined by the claims and by the breadth of interpretation allowed by law.

I claim:

1. A thermal garment for a person, the garment comprising:

a shell that is worn by a user and that overlays and covers a substantial portion of the back and chest of the user, the shell having inner and outer layers that define a chamber therebetween, the chamber overlaying a substantial portion of the back and chest of the user, the shell also having an access opening that extends from the chamber to outside the shell, to access the chamber; and a thermal insert that can be preheated to a preselected temperature to warm the user, and can be precooled to a preselected temperature to cool the user, the thermal insert substantially conforming to the chamber with a body portion and two leg portions that extend in the same general direction from the body portion, the thermal insert being removably positioned in the chamber, the thermal insert having a width and the access opening having a length that is about as long as the thermal insert is wide, so the thermal insert is easily and conveniently insertable into and removable from the chamber.

2. The thermal garment defined in claim 1, wherein the insert body substantially overlays and covers the back of the user, wherein one of the two legs extends over one of the user's shoulders from the body, and wherein the other of the two legs extends over the other of the user's shoulders from the body.

3. The thermal garment defined in claim 1, wherein the insert body is generally a right quadrilateral portion that substantially overlays and covers the user between the user's shoulders and hips, wherein one of the two legs extends toward one of the user's shoulders from the body, and wherein the other of the two legs extends toward the other of the user's shoulders from the body.

4. The thermal garment defined in claim 1, wherein the insert body is generally a right quadrilateral portion that has first and second opposing ends, and that substantially overlays and covers the user between the user's shoulders and hips, wherein the insert has a first leg that extends toward one of the user's shoulders from the body, near the first end, wherein the insert has a second leg that extends toward the other of the user's shoulders from the body, near the second end, and wherein the insert has a third leg that extends over the user's upper back, toward the user's neck, from the body, between the first and second ends.

5. The thermal garment defined in claim 1, wherein the insert has two congruent layers and multiple compartments defined between the two layers.

6. The thermal garment defined in claim 5, wherein one of the multiple compartments is sealed closed and contains a thermal storage medium.

7. The thermal garment defined in claim 1, wherein the insert is constructed in one, integral piece.

8. The thermal garment defined in claim 1, wherein the shell inner layer includes an air permeable layer that defines a thermal control baffle.

9. The thermal garment defined in claim 1, wherein the shell outer layer includes a thermal barrier layer.

10. The thermal garment defined in claim 1, wherein the access opening is positioned to overlay the upper back of the user and extends substantially between the opposing left and right sides.

11. The thermal garment defined in claim 1, wherein the shell further has a lower hem and a collar portion, has a front and an opposing back, and has a placket in the front, and wherein the placket defines the access opening, the access opening extending substantially between the lower hem and the collar portion.

12. The thermal garment defined in claim 1, wherein the shell has a lower hem and wherein the access opening is defined to extend substantially along the lower hem.

13. A thermal garment that is adapted to be worn by a person, the garment comprising:

a shell, the shell having opposing left and right sides, and having inner and outer layers that define a chamber therebetween, the chamber having a chamber back portion that generally overlays the back of a user, the chamber extending from the chamber back portion to a chamber left front portion that generally overlays the left chest of the user, and the chamber extending from the chamber back portion to a chamber right front portion that generally overlays the right chest of the user, the shell also having an access opening that extends through the outer layer to access the chamber and that extends substantially between the left and right sides; and a cooperating thermal insert that is adapted to be one of heated and cooled to a preselected temperature, the thermal insert being generally U-shaped with a bight portion and two legs that extend in generally the same direction from the bight portion, the thermal insert being removably inserted into the chamber with the bight portion positioned in the chamber back portion, one of the two legs positioned in the chamber left front portion, and the other of the two legs positioned in the chamber right front portion.

14. The thermal garment defined in claim 13, wherein the insert has a third leg that extends over the user's upper back, toward the user's neck, from the bight portion, the third leg being generally centered between the two legs.

15. The thermal garment defined in claim 13, wherein the insert is constructed in one, integral piece.

16. The thermal garment defined in claim 13, wherein the shell inner layer includes an air permeable layer that defines a thermal control baffle.

17. The thermal garment defined in claim 13, wherein the shell outer layer includes a thermal barrier layer.

* * * * *